US006810539B2

(12) United States Patent
Bosio

(10) Patent No.: US 6,810,539 B2
(45) Date of Patent: Nov. 2, 2004

(54) FAUCET WITH PULL-OUT DISPENSER

(75) Inventor: Orlando Bosio, Casaloldo (IT)

(73) Assignee: AMFAG S.p.A., Castel Goffredo (IT)

( * ) Notice: Subject to any disclaimer, the term of this patent is extended or adjusted under 35 U.S.C. 154(b) by 0 days.

(21) Appl. No.: 10/401,837

(22) Filed: Mar. 31, 2003

(65) Prior Publication Data

US 2003/0188381 A1 Oct. 9, 2003

(30) Foreign Application Priority Data

Apr. 4, 2002 (IT) ..... MN2002A0012

(51) Int. Cl.[7] ..... E03C 1/04
(52) U.S. Cl. ..... 4/678; 4/675
(58) Field of Search ..... 4/675–678, 695; D23/238, 255; 285/921

(56) References Cited

U.S. PATENT DOCUMENTS 5,158,234 A 10/1992 Magnenat et al. ..... 4/678
5,575,424 A * 11/1996 Fleischmann ..... 4/677
5,934,325 A 8/1999 Brattoli et al. ..... 4/678
6,220,297 B1 4/2001 Marty et al. ..... 4/678
6,588,453 B2 * 7/2003 Marty et al. ..... 4/678

FOREIGN PATENT DOCUMENTS

DE 31 38 414 4/1983
FR 2 824 341 11/2002

* cited by examiner

*Primary Examiner*—Tuan Nguyen
(74) *Attorney, Agent, or Firm*—Guido Modiano; Albert Josif; Daniel O'Byrne

(57) ABSTRACT

A faucet with pull-out dispenser comprising a tubular body that is adapted to accommodate a flexible element to which the dispenser is fixed at one end, the tubular body comprising snap-acting elements that are adapted to retain detachably, by elastic deformation, the dispenser in the position in which the flexible element is fully retracted into the body.

4 Claims, 5 Drawing Sheets

FAUCET WITH PULL-OUT DISPENSER

BACKGROUND OF THE INVENTION

The invention relates to a faucet with pull-out dispenser.

There is already a widespread diffusion of faucets, especially intended for kitchen sinks, which comprise a tubular body that is adapted to accommodate internally a flexible element that can be extracted from said body and has a water dispenser fixed thereto at one end.

In this manner, a user can move the dispenser from the inactive position, in contact with the outlet section of the tubular body, assumed as a consequence of the full retraction of the flexible element into said body, to positions that reach distant points of the sink, by using the possibility to extract the flexible element.

Aesthetic requirements mainly demand that the dispenser, in the inactive position, be in perfect contact with the outlet section of the tubular body that contains the flexible element, so as to give a compactness appearance to the faucet and a sense of continuity of the components. This condition however, often does not occur in conventional faucets. Various reasons, such as for example a certain rigidity of the flexible element and the weight of the dispenser, make such dispenser to arrange itself in the inactive position with a certain spacing from the outlet section of the tubular body, giving thus a clear visual indication of an incorrect condition.

SUMMARY OF THE INVENTION

The aim of the present invention is to provide a faucet with pull-out dispenser that ensures the condition in which, in the inactive position, the dispenser is in perfect contact with the outlet section of the tubular body that contains the flexible element.

This aim is achieved by a faucet with pull-out dispenser, according to the invention, comprising a tubular body that is adapted to accommodate internally a flexible element to which the dispenser is fixed at the end that is designed to protrude from the outlet section of said body, characterized in that the tubular body comprises snap-acting means adapted to retain detachably, by elastic deformation, the dispenser in the position in which the flexible element is fully retracted into said body.

Advantageously, the tubular body comprises, at the outlet section, a bush that is rigidly coupled thereto and is provided with wings that are adapted to engage, with a snap action by elastic deformation, a protrusion that is rigidly coupled to the dispenser.

BRIEF DESCRIPTION OF THE DRAWINGS

Further characteristics and advantages of the invention will become better apparent from the description of a preferred but not exclusive embodiment thereof, illustrated by way of non-limitative example in the accompanying drawings, wherein.

DESCRIPTION OF THE PREFERRED EMBODIMENTS

Figure 1:
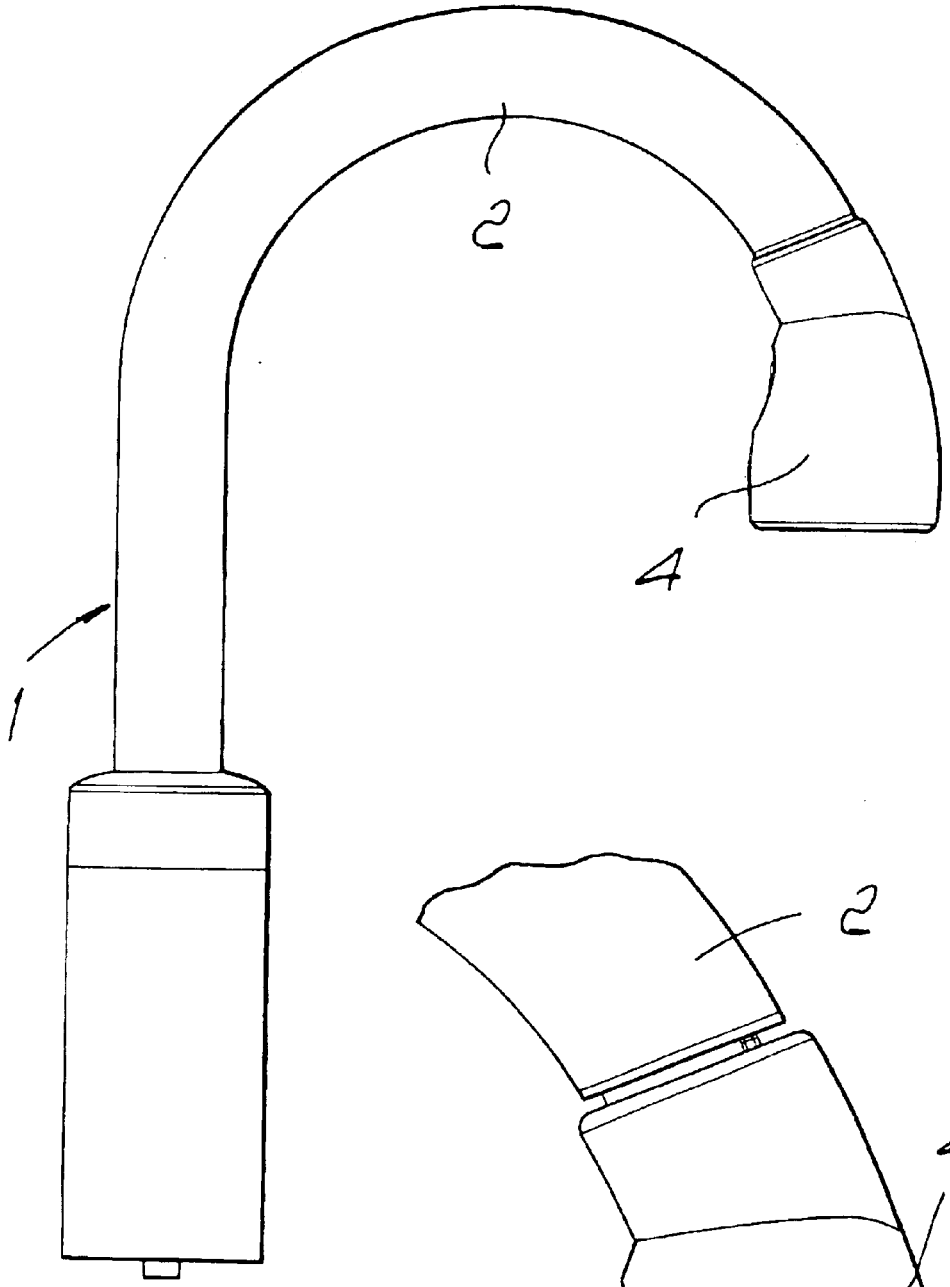
FIG. 1 is a side view of a faucet according to the invention.

With reference to the figures, the reference numeral 1 generally designates the faucet according to the invention, which comprises a tubular body 2, with an outlet section 2*a*, which is adapted to accommodate internally a pull-out flexible element 3 to which a dispenser 4 is fixed at the end; in this manner, the dispenser can be gripped by a user and moved from the inactive position, shown in the figures, to any position by using the possibility to extract the flexible element.

The dispenser 4 is fixed to the end of the flexible element 3, with the interposition of a sealing gasket 5, by screwing a cap 6, which is fitted movably over the flexible element, to a thread 4*a* that is present on the surface of a stem of the spray head: in this manner, a base 3*a* of the flexible element 3 remains trapped in contact with the end of the threaded stem of the spray head, with the gasket 5 interposed, by the action of a circumferential tooth 6*a*, which is located at the end of the cap 6.

All this occurs in a known manner.

Figure 2:
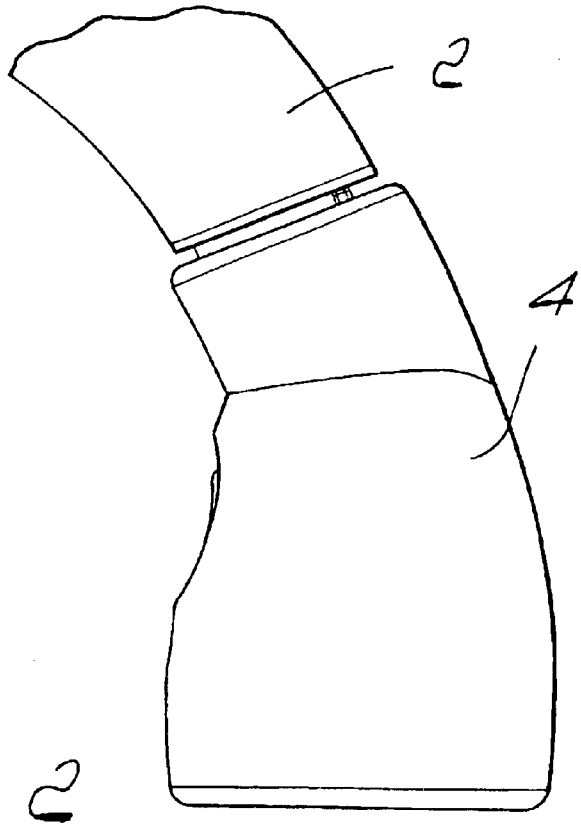
FIG. 2 is a partial view of a faucet in the incorrect condition that the invention aims to avoid.
Figure 3:
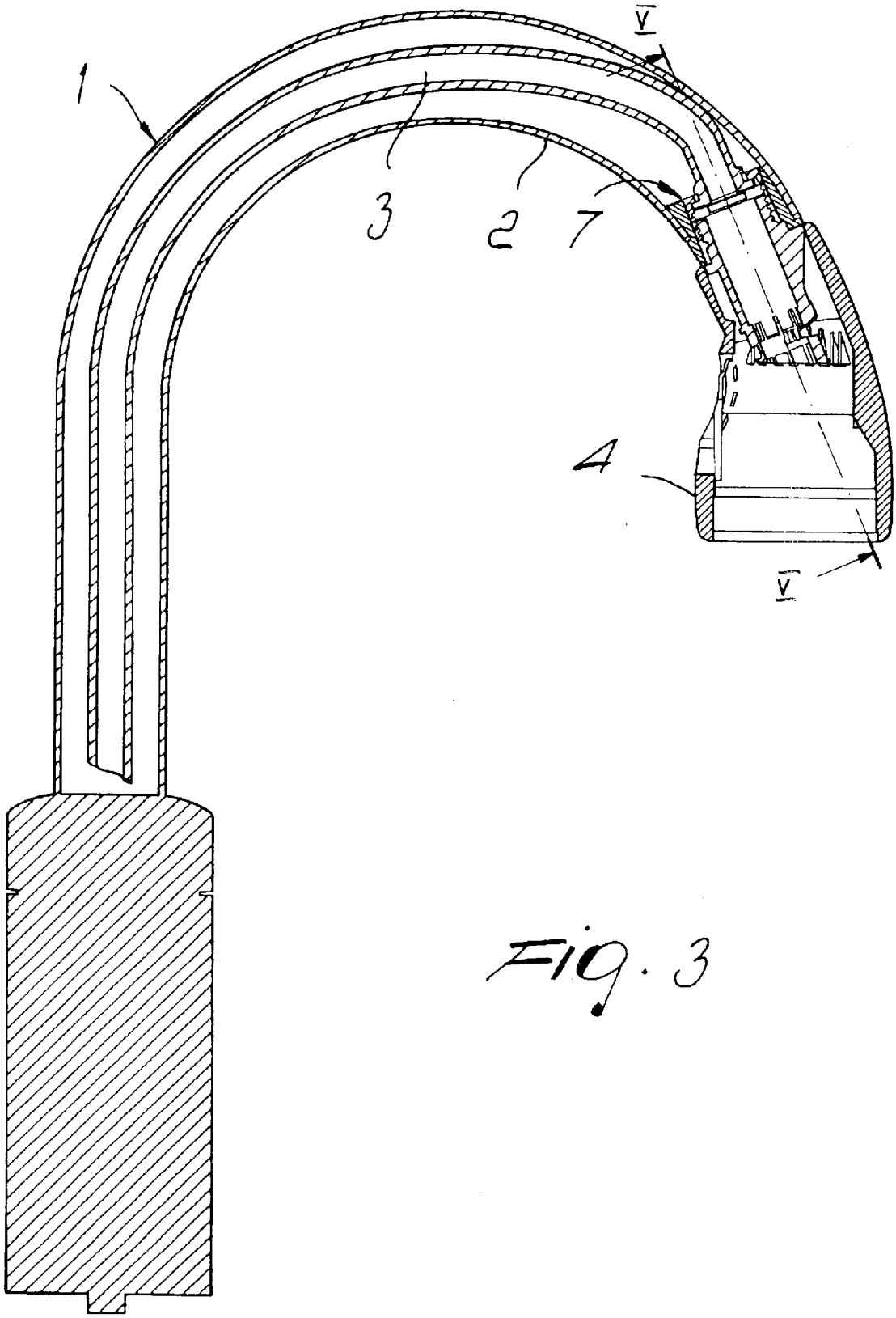
FIG. 3 is a sectional side view of the invention.
Figure 4:
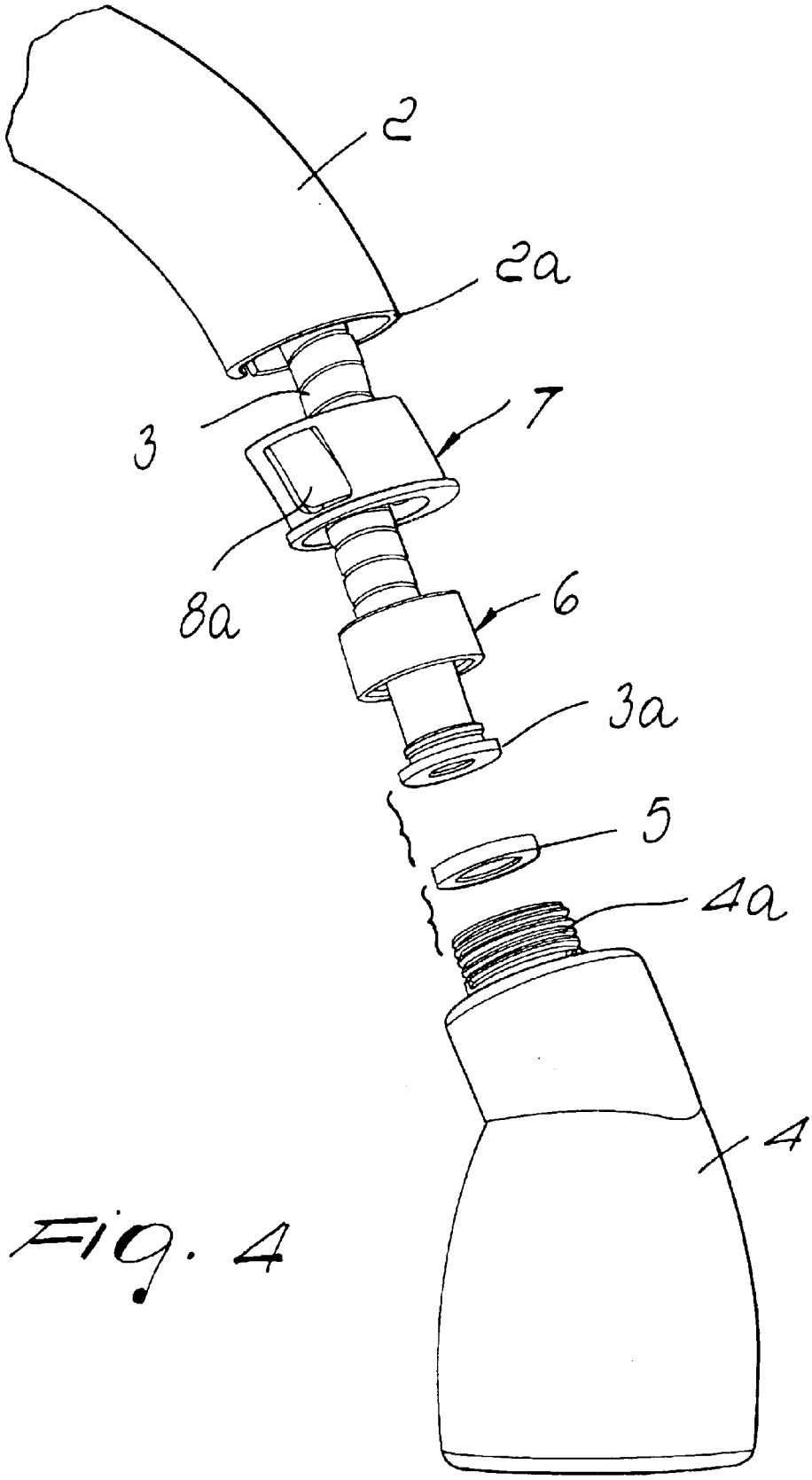
FIG. 4 is an exploded view of the invention.
Figure 5:
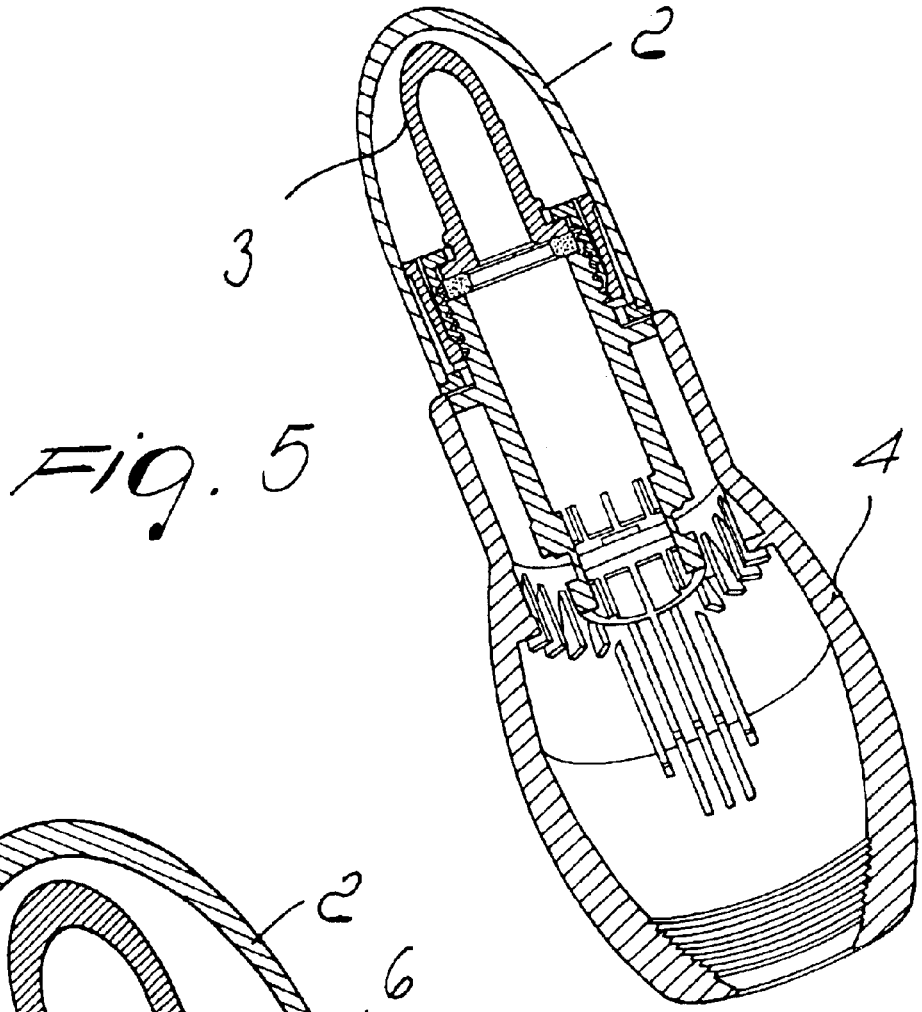
FIG. 5 is a sectional view, taken along the line V—V of FIG. 3.
Figure 6:
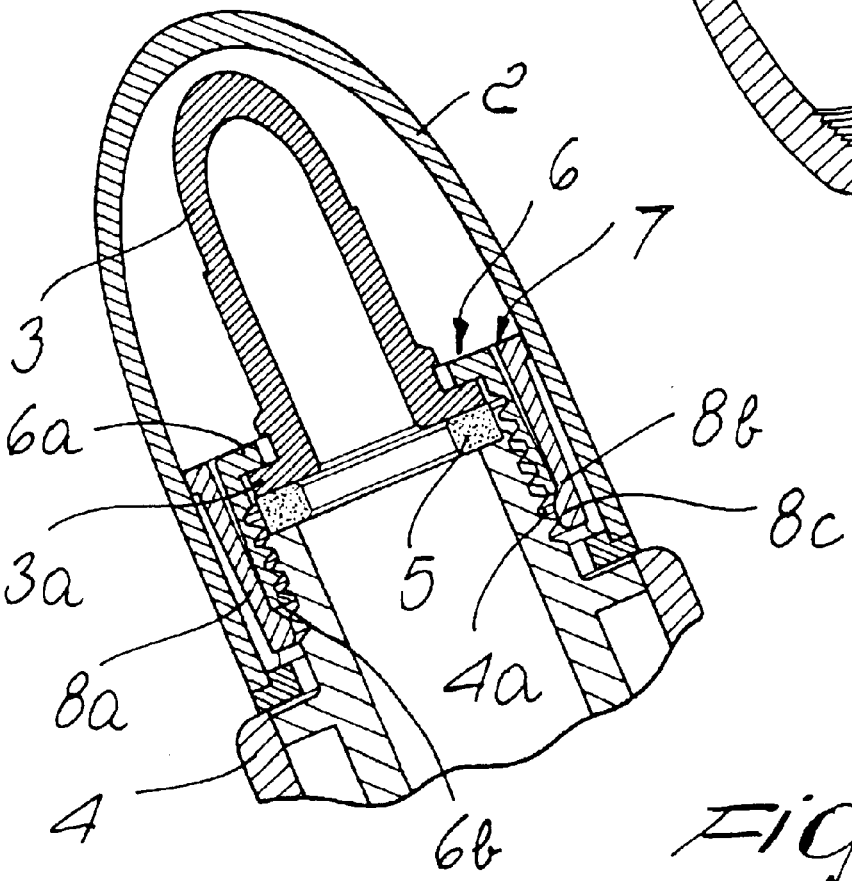
FIG. 6 is an enlarged-scale view of the detail shown in FIG. 5.
Figure 7:
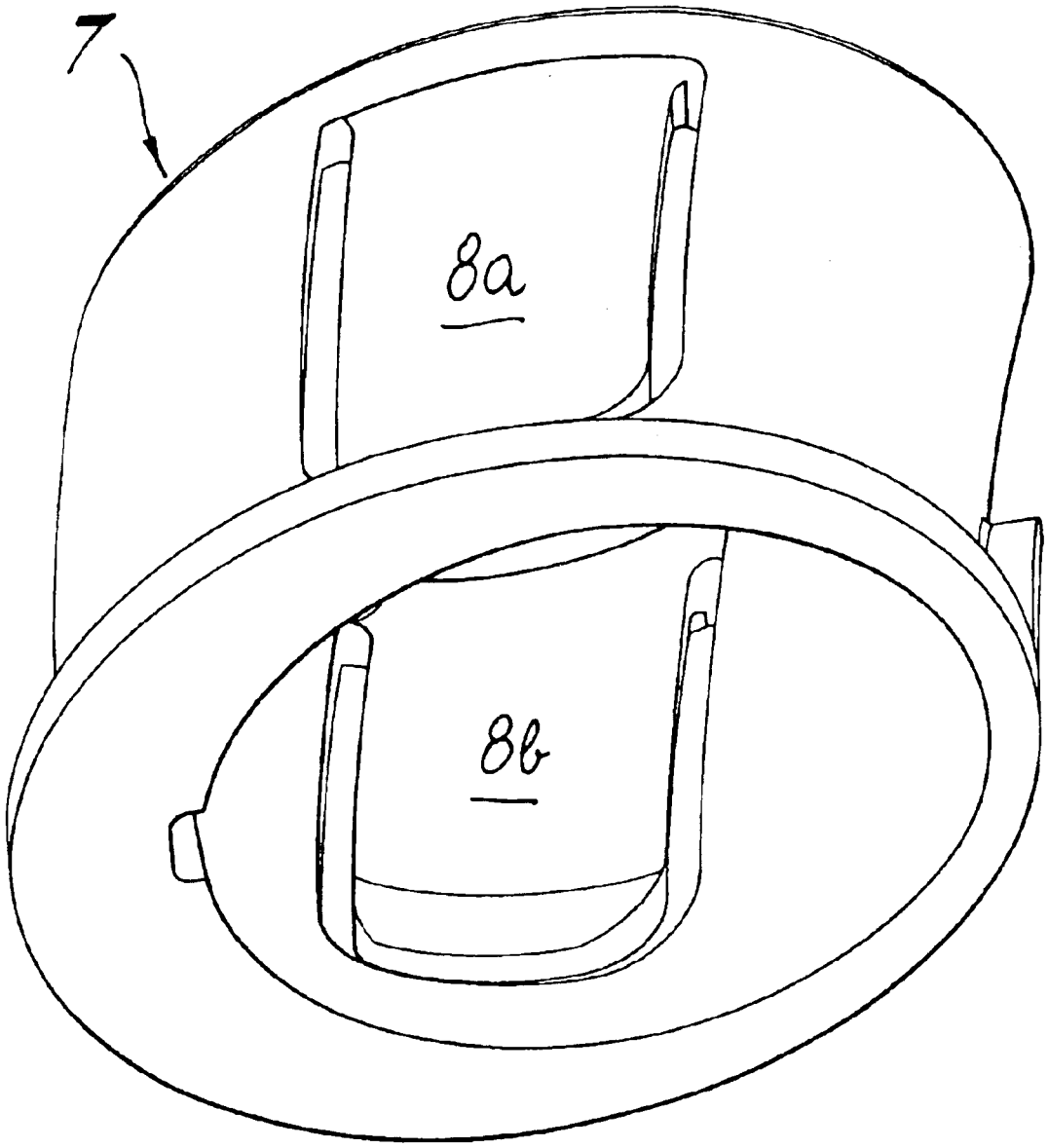
FIG. 7 is a perspective view of the bush.

An important feature of the invention is the presence of means, proximate to the outlet section 2*a* of the tubular body 2, that are adapted to retain, obviously in a detachable manner, the dispenser 4 in the correct inactive position shown in FIG. 1 and in FIGS. 3, 5 and 6, preventing the occurrence of the incorrect situation shown in FIG. 2.

Such retention means comprise a bush 7, which is rigidly coupled, by forcing and in the presence of an optional film of adhesive, to the end region is of the tubular duct 2, which is provided monolithically with the two mutually opposite wings 8*a* an 8*b*, which are adapted to engage with a snap action, by elastic deformation, at an end expansion 8*c*, with the lower edge or end 6*b* of the cap 6, as clearly shown in the detail of FIG. 6.

The dispenser 4 is therefore locked detachably in the intended inactive position by the action of said wings, and the retention force applied by said wings is calculated so as to ensure at the same time that the dispenser cannot accidentally leave the correct inactive position and that a user can easily pull out the dispenser and subsequently reinsert it easily.

The wings can of course be provided in any number and can engage by snap action any raised portion that is rigidly coupled to the dispenser, formed for example on the threaded stem of said dispenser or on the end cap of the flexible element.

The described invention is susceptible of numerous other modifications and variations, all of which are within the scope of the appended claims: all the details may further be replaced with other technically equivalent elements.

The disclosures in Italian Patent Application No. MN2002A000012 from which this application claims priority are incorporated herein by reference.

What is claimed is:

1. A faucet with pull-out dispenser, comprising:

a tubular body having an outlet section;

a flexible element, accommodated in said tubular body in an inactive configuration of said flexible element, and having a first end to which said dispenser is fixed;

snap-acting retention means arranged between an inner surface of said outlet section of said tubular body and an outer surface of said dispenser for retaining detachably, by elastic deformation of said retention means upon insertion of said dispenser in said outlet section of said tubular body, the dispenser at said outlet section of said tubular body in said inactive configuration in which the flexible element is fully retracted into said tubular body;

said retention means comprise an engagement portion rigidly coupled to the dispenser; and a bush that is rigidly coupled at said outlet section of said tubular body, said bush being provided with elastic wings for elastically engaging said engagement portion.

2. The faucet of claim 1, further comprising a cap that is arranged at a free end of the flexible element associated with said dispenser through a thread, said bush being provided with two mutually opposite wings, which engage at a lower edge of said cap, said lower edge of said cap being said engagement portion.

3. The faucet of claim 1, wherein in said inactive configuration of said flexible element said dispenser extends downwardly from said outlet section of said tubular body and said dispenser is detachably retained at said outlet section of said tubular body by said retention means.

4. A faucet with pull-out dispenser, comprising:

a tubular body having an outlet section;

a flexible element, accommodated in said tubular body in an inactive configuration of said flexible element, and having a first end to which said dispenser is fixed;

snap-acting retention means arranged between an inner surface of said outlet section of said tubular body and an outer surface of said dispenser for retaining detachably, by elastic deformation of said retention means upon insertion of said dispenser in said outlet section of said tubular body, the dispenser at said outlet section of said tubular body in said inactive configuration in which the flexible element is fully retracted into said tubular body;

said retention means comprise an engagement portion rigidly coupled to the dispenser; and a bush that is rigidly coupled at said outlet section of said tubular body, said bush being provided with elastic wings for elastically engaging said engagement portion, the faucet further comprising a cap that is arranged at a free end of the flexible element associated with said dispenser through a thread, said bush being provided with two mutually opposite wings, which engage at a lower edge of said cap, said lower edge of said cap being said engagement portion, and wherein in said inactive configuration of said flexible element said dispenser extends downwardly from said outlet section of said tubular body and said dispenser is detachably retained at said outlet section of said tubular body by said retention means.

* * * * *